United States Patent [19]

Uematsu et al.

[11] Patent Number: 4,657,685

[45] Date of Patent: Apr. 14, 1987

[54] EMULSION TYPE LIQUID LUBRICANT FOR METAL FORMING, PROCESS FOR PREPARING THE LUBRICANT AND PROCESS FOR METAL FORMING WITH THE LUBRICANT

[75] Inventors: Takao Uematsu, Hitachi; Shigeki Komatsuzaki, Mito; Fumio Nakano; Tomoe Takamura, both of Hitachi, all of Japan

[73] Assignee: Hitachi, Ltd., Tokyo, Japan

[21] Appl. No.: 683,639

[22] Filed: Dec. 19, 1984

[30] Foreign Application Priority Data

Dec. 19, 1983 [JP] Japan ..... 58-237826
Feb. 29, 1984 [JP] Japan ..... 59-36061

[51] Int. Cl.[4] ..... C10M 137/04

[52] U.S. Cl. ..... 252/32.5; 252/49.8; 252/56 R; 72/42

[58] Field of Search ..... 252/32.5, 46.6, 49.8, 252/49.5, 56 R, 51.5 R; 72/42

[56] References Cited

U.S. PATENT DOCUMENTS 3,510,426 5/1970 Papay ..... 252/46.6
4,185,485 1/1980 Schick et al. ..... 252/51.5 A
4,260,502 4/1981 Slanker ..... 252/46.6

*Primary Examiner*—Jacqueline V. Howard
*Attorney, Agent, or Firm*—Antonelli, Terry & Wands

[57] ABSTRACT

A substantially water-free, emulsion type liquid lubricant for metal forming which comprises:

(a) a lubricating oil, (b) at least one of phosphoric acid esters represented by the general formula:

$$(RO)_n-\overset{\overset{\displaystyle O}{\|}}{P}-(OH)_{3-n},$$

wherein R is alkyl, alkylalkenyl or aryl; n is an integer of 1 to 2, and (c) an emulsifying agent, an average particle size of the phosphoric acid ester being 0.3 to 120 μm, can form a lubricating film having distinguished heat resistance and lubricating properties by virtue of the heat generated by deformation and friction during the metal forming only by wetting the surface of a metallic workpiece or a die or both with the lubricant and work effectively for preventing galling, and thus parts with a high reduction of area or parts of complicated shapes can be readily formed.

A lubricating film having a lubricating effect equivalent to that of the conventional phasphate film can be simply obtained, greatly contributing to reduction in product cost.

An emulsion type liquid lubricant having a prolonged emulsion stability can be prepared through emulsification with a high speed mixer having a stirring blade with wiremesh-like fine perforations, and thus articles or parts with uniform quality can be formed.

10 Claims, 5 Drawing Figures

EMULSION TYPE LIQUID LUBRICANT FOR METAL FORMING, PROCESS FOR PREPARING THE LUBRICANT AND PROCESS FOR METAL FORMING WITH THE LUBRICANT

BACKGROUND OF THE INVENTION

This invention relates to an emulsion type lubricant for metal forming, which can form a lubricating film on a metal surface by virtue of the heat generated by deformation or friction during the metal forming such as cold forming, to a process for preparing said lubricant and also to a process for metal forming with said lubricant.

A lubricant for metal forming must have a satisfactory lubricating ability up to an elevated temperature caused by deformation, friction, etc. and also to increasing new surface area of a workpiece created by the metal formation. The lubricants so far proposed for this purpose are water-soluble or water-insoluble liquid lubricants containing mineral oil or synthetic oil or their mixture as the major component and further containing a semi-solid lubricant such as metal soap, beef tallow, etc., a sulfur-based, chlorine-based, or phosphorus-based extreme pressure agent, or a solid lubricant such as graphite, molybdenum disulfide, etc. These lubricants can be used, without any problem, for the metal forming with low reduction of area, but in the case of high reduction of area which produces a higher temperature or a higher surface pressure, or in the case of forming products of complicated shapes, their load-carrying capacity, heat resistance, etc. are not satisfactory, resulting in galling. For the lubrication for larger plastic deformation, or forming products of complicated shapes, it has been so far proposed to plate a workpiece surface with a soft metal, such as copper, etc., or to coat a workpiece surface with a plastic resin film. A treating process comprising a series of such steps as defatting-water washing-acid pickling-phosphate treatment-water washing-neutralization treatment-metal soap lubrication treatment-heat drying of a workpiece is also well known.

These lubricating coating treatments all require a sufficient pretreatment and complicated coating steps, and thus require so many labors and costs and also have further problems of removing the coatings after the forming or of environmental pollution by the waste liquid from the coating treatments or removal of the coatings after the forming.

Recently, lubricants containing phosphoric acid or its salts, boric acid or its salts, carbonates, nitrates, sulfates, or hydroxides of alkali metal, and laminar silicate, etc. have been proposed (Japanese Patent Application Kokai (Laid-open) No. 57-73089). However, since they consist of water-soluble glass powder of $P_2O_5$, $B_2O_2$ and $M_2O$ (where M represents an alkali metal), and the laminar silicate, or their mixture and water, they fail to show lubrication at a low temperature forming (below about 300° C.) such as cold forming.

Furthermore, a lubricant for cold forming, which is prepared by reaction of a multivalent metal cation, orthophosphate, and alkyl alcohol or alkylaryl alcohol having 10 to 36 carbon atoms, and which has a water content of not more than 20% by weight has been proposed (Japanese Patent Publication Kokai (Laid-open) No. 47-15569), and liquid or paste lubricants further containing mineral oil, carboxylic acid, and alkylamine besides the said lubricant components, and lubricants for cold forming, which comprises 30 to 90% by weight of a lubricant such as mineral oil, oleic acid, or oleylamine, 5 to 60% by weight of a reaction product of a multivalent metal cationic salt, polyphosphoric acid and an alcohol having 10 to 36 carbon atoms in a ratio of the metal cation:$P_2O_5$:the alcohol=1:3–60:14–150 by weight, and 0.5 to 10% by weight of water have been proposed (U.S. Pat. No. 3,932,287). These lubricants show good results in drawing processing of pipes, etc., but fail to meet the requirements for forming steel workpieces with high reduction of area.

SUMMARY OF THE INVENTION

An object of the present invention is to provide an emulsion type, substantially water-free, liquid lubricant for metal forming, which can have an excellent lubricating ability and a good heat resistance even under high reductions of area which produces a higher temperature and a higher pressure at the sliding interface between a tool and a workpiece, and can give a distinguished formability during the cold forming, where an extreme pressure agent is stably dispersed.

Another object of the present invention is to provide a process for preparing an emulsion-type, liquid lubricant for metal forming, where an extreme pressure agent is stably dispersed.

Other object of the present invention is to provide a process for metal forming in a very simple manner in forming a lubricating film, using an emulsion-type substantially water-free, liquid lubricant for metal forming, which can have an excellent lubricating ability and a good heat resistance even under high reductions of area which produces a higher temperature and a higher pressure, and can give a distinguished formability during the cold forming.

According to a first aspect of the present invention a lubricating film having a good heat resistance and a good lubricating ability is formed on the surface of a metallic workpiece by virtue of the heat generated by deformation, or friction during the metal forming only by wetting the surface of a metallic workpiece such as a steel workpiece, or the surface of a die with an emulsion-type substantially water-free, liquid lubricant for metal forming, which comprises a lubricating oil and at least one of organic phosphorus compounds, such as phosphoric acid esters represented by the following general formula (1):

$$(RO)_n-\overset{\overset{\displaystyle O}{\|}}{P}-(X)_{3-n} \qquad (1)$$

wherein R is alkyl, alkylalkenyl or aryl X is OH or H, and n is an integer of 1 to 2 when X is OH and 2 when X is H, and an appropriate amount of an emulsifying agent, where the phosphoric acid esters have an average particle size preferably of 0.3 to 120 μm, more preferably 0.5 to 80 μm, and particularly an always distinguished lubricating film can be formed by stabilizing a suspension state of phosphoric acid ester as an extreme pressure agent in a lubricating oil for a prolonged time.

According to a second aspect of the present invention, a dispersion stability of an organic phosphorus compound in an emulsion type liquid lubricant for metal forming, which comprises a lubricating oil, an organic phosphorus compound, for example, phosphoric acid ester, and an emulsifying agent, is much improved by mixing by means of a high speed mixer having an agitating blade or blades having a large number of fine perforations or mesh-like perforations to adjust the particle size of the organic phosphorus compound.

The lubricating oil for use in the present invention is the ordinary, commercially available lubricating oil, including, for example, mineral oil, synthetic oil such as ester oil, ether oil, silicone oil and fluorinated oil, and their mixtures.

It is preferable to select the viscosity of the lubricating oil in view of metal forming conditions.

The phosphoric acid ester represented by the general formula (1) includes, for example, dibutyl hydrogen phosphite, diphenyl hydrogen phosphite, diisodecyl hydrogen phosphite, monobutyl phosphate, monoisodecyl phosphate, or mono- and di-alkyl mixtures such as methyl acid phosphate, isopropyl acid phosphate, butyl acid phosphate, etc.

When these extreme pressure agents are in a state of solution in a lubricating oil, the effect of addition of the extreme pressure agent is not better, and no better formability is obtained. That is, a better formability can be obtained by uniformly suspend or disperse the extreme pressure agent in a mineral oil, a synthetic oil or their mixed oil, which is incapable of dissolving the extreme pressure agent, or by dispersing the extreme pressure agent therein in an emulsion state.

As the emulsifying agents for uniformly dispersing these extreme pressure agents in a mineral oil, a synthetic oil or their mixed oil, (A) at least one of polymethacrylate, polyisobutylene, olefin copolymer, polyalkylstyrene, etc. and (B) at least one of the so called polymeric succinic acid derivatives such as polybutenyl succinic acid anhydride prepared by maleinizing polybutene, polybutenyl succinimide, or polybutenyl succinic acid ester prepared by reaction of polybutenyl succinic acid anhydride with an amine or an alcohol, and copolymers of long chain alkyl acrylate or methacrylate with methacrylate monomers containing a polar group such as amine, amide, iminimide, nitrile, etc. are used at the same time in the present invention.

The present emulsion type, liquid lubricant can have a good effect of preventing a die and a metallic workpiece from their direct contact during the metal forming, whereby articles of complicated shape or parts with a higher reduction of area can be formed and also dimensional precision of the formed parts can be considerably improved. This is because the fine particles of phosphoric acid ester in the liquid lubricant tightly adhere much to the surface of a metallic workpiece, and a dense and strong lubricating film is formed by virtue of the heat generated by deformation during the metal forming, whereby the occurrence of fouling or galling on the surface of a metallic workpiece can be reduced and a considerably prolonged die durability and an effective reduction of die damage can be expected.

To disperse the extreme pressure agent in a lubricating oil, to keep the suspension state for a prolonged time, and to form a dense and strong lubricating film on the surface of a metallic workpiece during the metal forming, thereby improving the galling resistance, it is desirable that the particle size of the extreme pressure agent is not more than 120 μm. Particularly when a practically stable period as emulsion stability, for example, at least 30 days, is taken into account, it is desirable that the particle size of the extreme pressure agent is not more than 80 μm.

In the present invention it is preferable to use 2 to 30 parts by weight of the phosphoric acid ester represented by the general formula (1) as the organic phosphorus compound per 100 parts by weight of the lubricating oil. Below 2 parts by weight, the formation of a lubricating film is deteriorated, so that no sufficient formability can be obtained and sometimes galling occurs. Above 30 parts by weight, no better effect can be obtained, and thus the excessive addition is not economical.

In the present invention, it is preferable to use at least 2 parts by weight of the emulsifying agent (A) and at least 0.04 parts by weight of the emulsifying agent (B) per 100 parts by weight of the lubricating oil. An excessive amount of the emulsifying agent (A) will not deteriorate the formability, whereas more than 5 parts by weight of the emulsifying agent (B) will deteriorate the formability and thus is not preferable.

The present liquid lubricant can be put into service only by wetting the surface of a metallic workpiece or a die for metal forming with the present liquid lubricant according to the well known method, for example, by spraying, brushing, roll coating, etc., followed by metal forming, or can be also attained by heating either the present liquid lubricant or the metallic workpiece and dipping the metallic workpiece into the lubricant, thereby forming a lubricating film on the surface of metallic workpiece. For example, a metallic workpiece is dipped into the present liquid lubricant heated to at least 50° C. for 0.5–10 minutes, for example, 100° C. for 0.5 minutes, whereby a lubricating film having a lubricating effect equivalent or superior to that of the conventional phosphate film and a high rust-proof effect on the metallic workpiece can be very readily formed. Thus, the present invention can considerably shorten the lubricating film-forming process.

An antioxidant for preventing deterioration of the present liquid lubricant, a rust proof agent for preventing a metallic workpiece from rust, etc. can be added to the present liquid lubricant, so far as they are not in ranges to deteriorate the desired lubricating effect of the present invention.

A process for preparing the present emulsion-type liquid lubricant having a distinguished emulsion stability will be described below.

When an emulsion or a suspension is prepared by uniformly dispersing mutually insoluble liquid themselves or a liquid and a solid, the stability of a dispersion state of a dispersoid is practically important. Generally, the phase separation of the dispersoid is suppressed with an emulsion stabilizer, a dispersion stabilizer, etc. In the present invention, a specific emulsifying agent is also used, as described above, to stabilize the emulsion, but the lubricating ability is influenced by some emulsifying agent, and thus it is not preferable to add a large amount of an emulsifying agent to a lubricating oil.

As an alternative thereto, dispersion can be also stabilized by giving a strong shearing force to a dispersion, for example, by a high speed mixer, etc., thereby reducing the particle size of dispersoid, but much reduced particle size also has an influence on the formability, and thus the stabilization by shearing force has a problem.

The present invention provides a process for preparing an emulsion type, liquid lubricant having a good dispersion stability of phosphoric acid ester as a dispersoid, where the emulsion stability can be improved only with stirring by means of a stirring apparatus provided with a special stirring blade.

Generally in the dispersion system it is theoretically supported that the more uniform the particle size, the more improved the dispersion stability is. The reason why the stabilization has been so far attempted by making the particle size as small as possible is that it is difficult to make the particle size uniform when the particle sizes are large, and thus it has been presumed that if the particle sizes could be made uniform, the stabilization would be possible even with relative large particle sizes.

Shape, dimension, etc. of the stirring blades of stirring apparatuses such as the ordinary high speed mixer, etc. have been so far studied for the purpose of making a liquid flowable or shearing a liquid, so that the studies have been concentrated on the types of stirring blades as classified into so called propeller type, turbine type and paddle type (the paddle type refers to the type of at least two stirring blades provided on one and same shaft on different levels in contrast to the propeller type), and improvements of their shapes have been so far made. However, these stirring blades have been proposed only in view of the mixing efficiency, and no consideration has been given yet to preparation of a dispersion of dispersoid having relatively uniform particle sizes as desired in the present invention. In actual tests of the conventional stirring blades, it has been impossible to obtain the desired dispersion.

As a result of extensive studies, the present inventors have found that the desired object of the present invention can be attained by using stirring blades of novel shape.

In the present invention, mixing is carried out with a mixer having a stirring blade with a large number of fine perforations or mesh-like perforations, and particularly the opening size of fine perforations is selected in view of the particle size of dispersoid, and can be preferably about 1,000 times as large as the particle size of dispersoid. That is, a wiremesh having mesh sizes of 10 to 100 mesh or perforations having the opening sizes corresponding thereto is preferable, where the number of revolution per minute of the blade is preferably 140 to 700 rpm.

When the present emulsion type, liquid lubricant is prepared with a mixer having a stirring blade with a uniform wiremesh shown in FIG. 4 according to one embodiment of the present invention, a liquid lubricant having a good emulsion stability, in which the particle sizes of the dispersed phosphoric acid ester are relatively uniform, can be obtained. Its principle has not been clarified yet, but it seems that the fine perforation provided on the stirring blade works as a kind of sieve to be dispersoid, making the particle sizes of dispersoid uniform. The reason why the uniform particle size of dispersoid can improve the emulsion stability is that the sedimentation velocity v of dispersoid can be determined according to the following equation and is proportional to the square of particle size r:

$$v=2r^2(\rho_2-\rho_1)g/\eta$$

r: particle size of dispersoid
$\rho_1$, $\rho_2$: density
g: gravity
$\eta$: viscosity So far as $\rho 1$, $\rho_2$ and $\eta$ are constant in the foregoing equation, that is, the smaller the particle size of dispersoid, the smaller the sedimentation velocity v and the more improved the emulsion stability.

When the particle sizes are not uniform, the particles with larger particle sizes more rapidly settle, and the emulsion stability is deteriorated on the whole.

DETAILED DESCRIPTION OF PREFERRED EMBODIMENTS

Examples 1–14

Added to 100 parts by weight of mineral oil having a viscosity of 56 $mm^2$/sec at 40° C. were 6.7 parts by weight or 14.3 parts by weight of polymethacrylate (Kanelube 2000, made by Kanebo NSC, Ltd., Japan) as emulsifying agent (A) and polybutenylsuccinic acid ester (Lubrisol 939, made by Nippon Lubrisol, Ltd., Japan) in mixing ratios shown in Table 1, followed by heat dissolution. Then, 26.7 parts by weight or 28.6 parts by weight of monobutyl phosphate as an extreme pressure agent was added thereto. Then, the mixtures were stirred in a homogenizer, whereby emulsified lubricants were obtained. The lubricants were then placed into test tubes and left standing at room temperature (25° to 27° C.). The emulsion stability was evaluated by measuring the time until which the phase separation started to occur. The results of evaluation are also shown in Table 1. The emulsion stability was evaluated to be better, if the time until the lubricating oil and the extreme pressure agent started to separate from each other, that is, until the phase separation started to occur, was longer.

Lubricants for Comparative Examples 1 to 4 had a basic composition consisting of 100 parts by weight of mineral oil having a viscosity of 56 $mm^2$/sec at 40° C. as a base oil, and 26.7 parts by weight of monobutyl phosphate as an extreme pressure agent, to which 5 parts by weight of the following emulsifying agent was added.

| | Emulsifying agent |
|---|---|
| Comparative Example 1 | Polybutenylsuccinic acid ester |
| Comparative Example 2 | Polymethacrylate |
| Comparative Example 3 | Copolymer of polymethacrylate and N—vinylpyrrolidone (average molecular weight: 450,000) |
| Comparative Example 4 | None |

As is evident from Table 2, the liquid lubricants containing polymethacrylate and polybutenyl succinic acid ester as emulsifying agents had no phase separation for a longer time than those of Comparative Examples, and thus had a distinguished emulsion stability.

The average particle size of monobutyl phosphate as a dispersoid of the emulsion type, liquid lubricants was 50 mμ, which was determined by sampling a small amount of the thus prepared lubricants into glass dishes and visually measuring the size with an optical microscope.

The emulsion stability was the time measured until a phase separation started to occur while keeping a glass test tube containing a sample of the liquid lubricant constant at a predetermined temperature in a thermostat.

Figure 1:
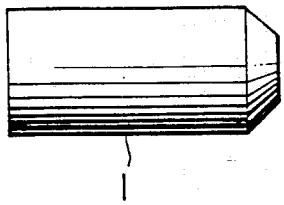
FIG. 1 is a side view of a workpiece used for evaluation of the properties of lubricants.

The present liquid lubricants of Examples 1 to 14 having compositions shown in Table 1, and the lubricants of Comparative Examples 1 to 4, were applied to the surfaces of workpieces 1, as shown in FIG. 1, chromium-molybdenum steel columns with a nose, 9.9 mm in diameter, 30 mm long and 90° at nose angle [SCM 415 as described in JIS (Japanese Industrial Standard G 4105: C: 0.13–0.18 wt.%, Si: 0.15–0.35 wt.%, Mn: 0.60–0.85 wt.%, P: under 0.030 wt.%, S: under 0.030 wt.%, Cr: 0.90–1.20 wt.%, Mo: 0.15–0.30 wt.%, the balance being Fe)].

Figure 2:
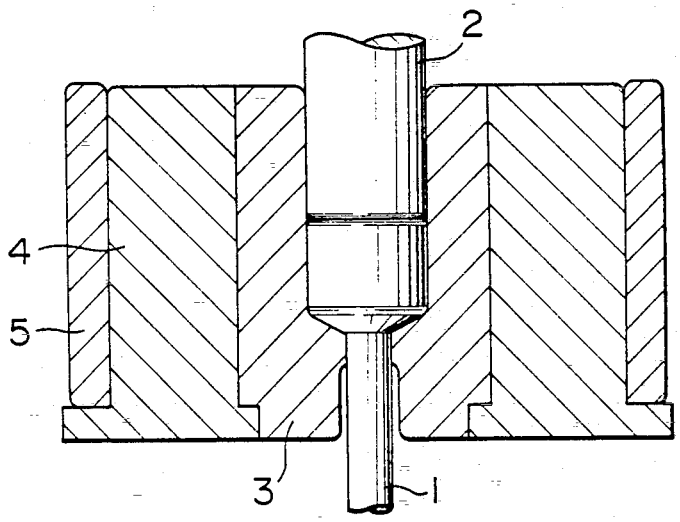
FIG. 2 is a vertical cross-sectional view of an extrusion die used for evaluation of the properties of lubricants.

Then, the workpieces 1 were subjected to metal forming by forward extrusion with an ultra-hard die 3 with an extrusion angle of 120° and an extrusion diameter of 5 mm (reduction of area: 75%) and a punch 2, as shown in FIG. 2 to evaluate the formability of the lubricants. The results of evaluation are shown in Table 2.

The formability was evaluated as follows. A band heater 5 was provided around the die 4 to elevate the die temperature stagewise, for example, by 5° to 10° C. for each stage, and 30 workpieces 1 of each Example, to which the lubricants were applied, were subjected to metal forming, and maximum die temperatures up to which no galling developed on the surfaces of workpieces after the metal forming were measured.

That is, a higher maximum die temperature has a better formability of the lubricant.

TABLE 1

| Example No. | Mixing ratio of emulsifying agent (parts by weight) Polybutenyl succinic acid ester | Polymethacrylate (950) | Emulsion stability (day) |
|---|---|---|---|
| 1 | 0.06 | | 14 |
| 2 | 0.13 | | 25 |
| 3 | 0.20 | | 30 |
| 4 | 0.26 | 6.7 | 36 |
| 5 | 0.53 | | 40 |
| 6 | 0.80 | | 42 |
| 7 | 1.06 | | 48 |
| 8 | 0.03 | | 8 |
| 9 | 0.06 | | 10 |
| 10 | 0.08 | | 18 |
| 11 | 0.11 | 14.3 | 27 |
| 12 | 0.14 | | 35 |
| 13 | 0.28 | | 49 |
| 14 | 0.57 | | 60 |
| Comp. Ex. 1 | 6.7 | — | 2 |
| Comp. Ex. 2 | — | 6.7 | 4 |
| Comp. Ex. 3 | Copolymer of methacrylate and N—pyrrolidone | | 7 |
| Comp. Ex. 4 | None | | 40 min. |

Remark:
Value in parentheses ( ) shows a viscosity ($mm^2$/sec) at 100° C.

After the forming at the die temperature of 150° C., the surface of workpiece was measured by a X-ray microanalyzer to determine the phosphorus concentration.

It is evident that a more dense lubricating film was formed on the surface of workpiece, when the detected phosphorus concentration was higher.

TABLE 2

| Example No. | Formability (°C.) | State of lubricating film formed after forming at 150° C. |
|---|---|---|
| 1 | 200 | ○ |
| 2 | 210 | ○ |
| 3 | 210 | ○ |
| 4 | 210 | ○ |
| 5 | 210 | ○ |
| 6 | 215 | ○~◎ |
| 7 | 210 | ○ |
| 8 | 200 | ○ |
| 9 | 200 | ○ |
| 10 | 210 | ○ |
| 11 | 200 | ○ |
| 12 | 190 | ○ |
| 13 | 180 | Δ~○ |
| 14 | 180 | Δ~○ |
| Comp. Ex. 1 | 150 | X~Δ |
| Comp. Ex. 2 | 160 | X~Δ |
| Comp. Ex. 3 | 155 | X~Δ |
| Comp. Ex. 4 | 155 | X~Δ |

State of formed lubricating film
◎ Phosphorus elements well distributed densely all over the surface.
○ Phosphorus elements were segregated almost all over the entire surface
Δ Phosphorus elements were segregated locally.
X Phosphorus elements deposited in a very small amount.

As is obvious from Table 2, the present emulsifying agents had a good formability without inhibiting the reactivity of the extreme pressure agent to the metallic workpiece, and also good lubricating films were formed on the surface of metallic workpiece after the forming.

Examples 15–39

Added to the same mineral oil as used in Example 1 were polyisobutylene (PARATONE 108, made by Exxon Chem. Corp., U.S.A.), polyolefin polymer (PARATONE 707, made by Exxon Chem. Corp., U.S.A.), copolymer of styrene-isobutylene (Shellvis 50, made by Shell Chemical Co., U.S.A.), or acrylic polymer (PLEXOL HF 833, made by Nippon Acryl Kagaku K.K., Japan) or copolymer of ethylene-α-olefin (#1010, made by Mitsui Petrochemical Industries, Ltd., Japan) as emulsifying agent (A), and polybutenylsuccinic acid ester as emulsifying agent (B) in the mixing ratios shown in Table 3, followed by heat dissolution. Then, 26.7 parts by weight of monobutyl phosphate was added thereto as an extreme pressure agent, and the resulting mixtures were stirred in a homogenizer, whereby emulsified lubricants containing monobutyl phosphate having an average particle size of 45 mμ were obtained. The lubricants were placed into 50-ml test tubes and left standing at room temperature (25° to 27° C.) to evaluate the emulsion stability. The results of evaluation are shown in Table 3.

The lubricants were also applied to steel plates (SPCE), 200 mm in diameter and 8 mm thick, and the plates were subjected to deep drawing into cup forms, 140 mm in inner diameter and 7 mm thick (ironing ratio: 12.5%). It was found that good formability was obtained with each lubricant.

TABLE 3

| Ex. No. | Mixing ratio of emulsifying agents (parts by weight) Polybutenyl-succinic acid ester | Polyiso-butylene (650) | Olefin copolymer (650) | Styrene-isobutynene copolymer (800) | Acrylic polymer (960) | Ethylene-α-olefin copolymer (2600) | Emulsion stability (day) |
|---|---|---|---|---|---|---|---|
| 15 | 0.06 | 1.3 | | | | | 4 |
| 16 | | | 1.3 | | | | 4 |
| 17 | | | | 1.3 | | | 5 |
| 18 | | | | | 1.3 | | 5 |
| 19 | | | | | | 1.3 | 7 |
| 20 | 0.06 | 2.6 | | | | | 10 |
| 21 | | | 2.6 | | | | 9 |
| 22 | | | | 2.6 | | | 10 |
| 23 | | | | | 2.6 | | 10 |
| 24 | | | | | | 2.6 | 14 |
| 25 | 1.06 | 3.9 | | | | | 15 |
| 26 | | | 3.9 | | | | 16 |
| 27 | | | | 3.9 | | | 16 |
| 28 | | | | | 3.9 | | 16 |
| 29 | | | | | | 3.9 | 17 |
| 30 | 0.06 | 5.3 | | | | | 20 |
| 31 | | | 5.3 | | | | 20 |
| 32 | | | | 5.3 | | | 20 |
| 33 | | | | | 5.3 | | 19 |
| 34 | | | | | | 5.3 | 23 |
| 35 | 0.06 | 6.7 | | | | | 21 |
| 36 | | | 6.7 | | | | 21 |
| 37 | | | | 6.7 | | | 20 |
| 38 | | | | | 6.7 | | 20 |
| 39 | | | | | | 6.7 | 25 |

Remark: Value in parenthese ( ) shows a viscosity ($mm^2$/sec) at 100° C.

Examples 40–42

Added to 100 parts by weight of α-olefin oil having a viscosity of 100 $mm^2$/sec at 40° C., polyol ester oil having a viscosity of 56 $mm^2$/sec at 40° C., or fluorosilicone oil having a viscosity of 100 $mm^2$/sec at 40° C. as a base lubricating oil were 6.7 parts by weight of polymethacrylate as emulsifying agent (A) and 0.26 parts by weight of polybutenylsuccinic acid ester as emulsifying agent (B), followed by heat dissolution. Then, 27.4 parts by weight of monobutyl phosphate was added thereto, and the resulting mixtures were stirred and emulsified in a homogenizer. The average particle size of monobutyl phosphate in the resulting liquid lubricants was 45–50 μm. The emulsion stability and formability of the resulting liquid lubricants are shown in Table 4.

TABLE 4

| Ex. No. | Base Oil | Emulsion stability (day) | Formability (°C.) |
|---|---|---|---|
| 40 | α-olefin oil | 41 | 215 |
| 41 | Polyol ester oil | 40 | 190 |

TABLE 4-continued

| Ex. No. | Base Oil | Emulsion stability (day) | Formability (°C.) |
|---|---|---|---|
| 42 | Fluorosilicone oil | 42 | 200 |

Examples 43–72

Added to a mineral oil having a viscosity of 56 $mm^2$/sec at 40° C. were emulsifying agents (A) and (B) in mixing ratios shown in Table 5, followed by heat dissolution. Then, 26.7 parts by weight of monobutyl phosphate was added thereto, and the mixture was stirred in a homogenizer, whereby an emulsified liquid lubricant containing the monobutyl phosphate having an average particle size of 40 to 50 μm was obtained. A portion of the thus obtained liquid lubricant was placed in 50 ml sample tubes and left standing at room temperature (25° to 27° C.) to evaluate the emulsion stability. Furthermore, the state of lubricating films formed on the surfaces of metallic workpieces after the forming was evaluated. The results of the evaluation are shown in Table 6.

TABLE 5

| Ex. No. | Emulsifier (A) | Emulsifier (B) Polyalkenyl succinic acid anhydride | Alkenyl succinic acid imide | Polybutenyl succinic acid ester | Lauryl acrylate | Copolymer of methacrylic acid ester and nitrile |
|---|---|---|---|---|---|---|
| 43 | Polymeth- | 0.02 | | | | |
| 44 | acrylate | | 0.02 | | | |
| 45 | (950) | | | 0.02 | | |
| 46 | 6.7 parts | | | | 0.02 | |
| 47 | by weight | | | | | 0.02 |
| 48 | | 0.04 | | | | |
| 49 | | | 0.04 | | | |
| 50 | | | | 0.04 | | |
| 51 | | | | | 0.04 | |
| 52 | | | | | | 0.04 |
| 53 | Polyiso- | 0.02 | | | | |

TABLE 5-continued

| Ex. No. | Emulsifier (A) | Emulsifier (B) Polyalkenyl succinic acid anhydride | Alkenyl succinic acid imide | Polybutenyl succinic acid ester | Lauryl acrylate | Copolymer of methacrylic acid ester and nitrile |
|---|---|---|---|---|---|---|
| 54 | butyrene | | 0.02 | | | |
| 55 | (650) | | | 0.02 | | |
| 56 | 6.7 parts | | | | 0.02 | |
| 57 | by weight | | | | | 0.02 |
| 58 | | 0.04 | | | | |
| 59 | | | 0.04 | | | |
| 60 | | | | 0.04 | | |
| 61 | | | | | 0.04 | |
| 62 | | | | | | 0.04 |
| 63 | Ethylene- | 0.02 | | | | |
| 64 | α-olefin | | 0.02 | | | |
| 65 | copolymer | | | 0.02 | | |
| 66 | (2,600) | | | | 0.02 | |
| 67 | 6.7 parts | | | | | 0.02 |
| 68 | | 0.04 | | | | |
| 69 | | | 0.04 | | | |
| 70 | | | | 0.04 | | |
| 71 | | | | | 0.04 | |
| 72 | | | | | | 0.04 |

TABLE 6

| Ex. No. | Emulsion stability (day) | State of formed lubricating film |
|---|---|---|
| 43 | 5 | Δ |
| 44 | 5 | Δ |
| 45 | 5 | Δ |
| 46 | 7 | Δ~○ |
| 47 | 7 | Δ~○ |
| 48 | 9 | ○ |
| 49 | 9 | ○ |
| 50 | 9 | ○ |
| 51 | 13 | ○ |
| 52 | 15 | ○ |
| 53 | 4.5 | Δ |
| 54 | 5 | Δ |
| 55 | 5 | Δ |
| 56 | 7 | Δ~○ |
| 57 | 7 | Δ~○ |
| 58 | 10 | ○ |
| 59 | 10 | ○ |
| 60 | 9.5 | ○ |
| 61 | 14 | ○ |
| 62 | 15 | ○ |
| 63 | 5 | Δ |
| 64 | 5 | Δ |
| 65 | 5.5 | Δ |
| 66 | 6.5 | Δ~○ |
| 67 | 7 | Δ~○ |
| 68 | 12 | ○ |
| 69 | 12 | ○ |
| 70 | 11.5 | ○ |
| 71 | 18 | ○ |
| 72 | 20 | ○ |

Figure 3:
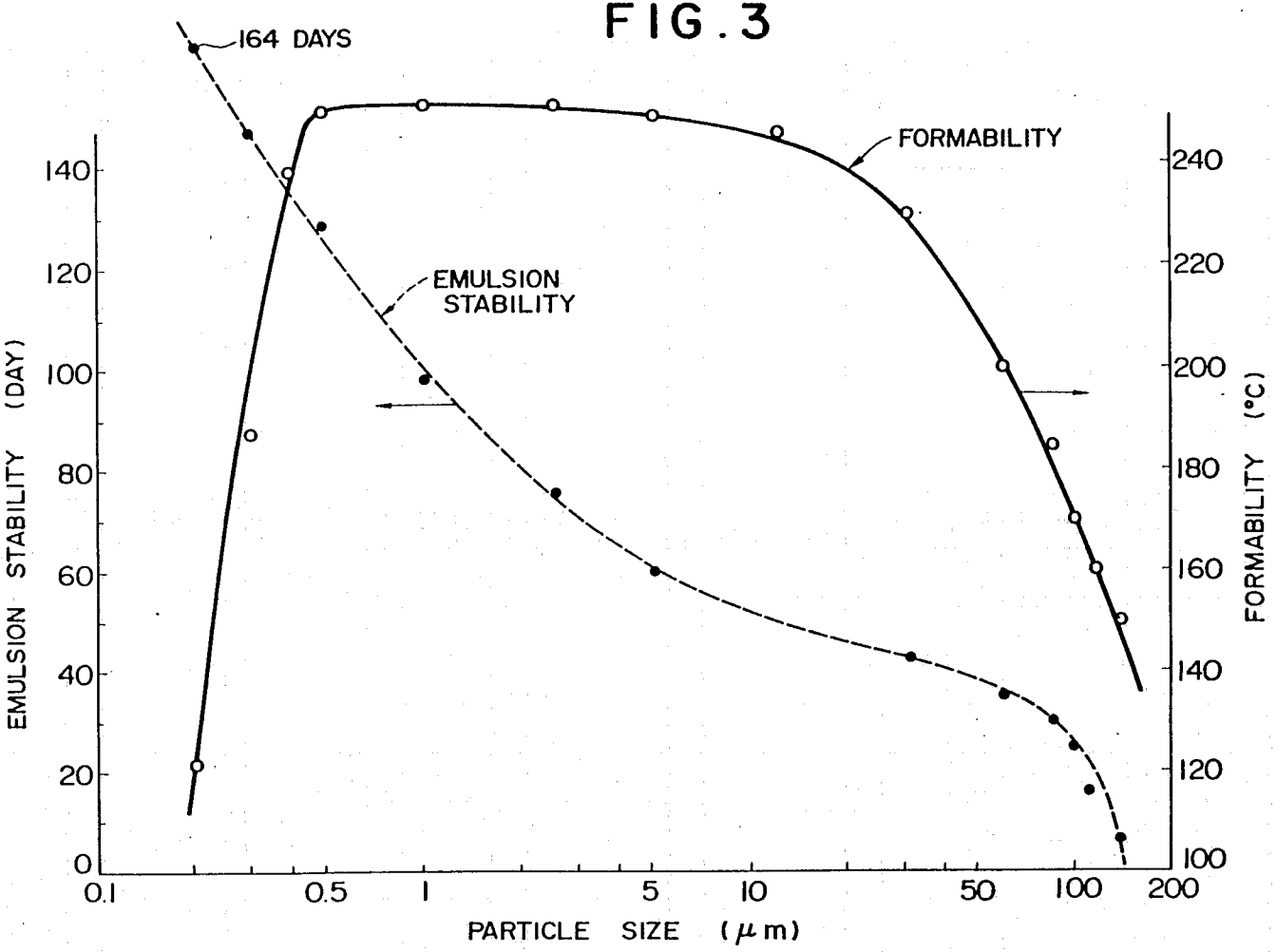
FIG. 3 is a diagram showing influences of particle size of dispersoid (organic phosphorus compound) in liquid lubricants according to Examples.

As is evident from Table 7 and FIG. 3, a good emulsion stability can be obtained when the average particle size of dispersoid is 120 μm or less, preferably 80 μm or less, and a good formability can be obtained, when the average particle size of dispersoid is at least 0.3 μm, preferably 0.5 to 140 μm.

TABLE 7

| Ex. No. | Emulsifying agent (A) | Emulsifying agent (B) | Average particle size of extreme pressure agent (μm) | Emulsion stability (day) | Formability (°C.) |
|---|---|---|---|---|---|
| 73 | Polymeth- | Poly- | 140 | 7 | 150 |
| 74 | acrylate | butenyl- | 120 | 16 | 160 |
| 75 | (6.7 parts | succinic | 100 | 25 | 170 |
| 76 | by weight) | acid ester | 80 | 30 | 185 |
| 77 | | (0.26 parts | 60 | 35 | 200 |
| 78 | | by weight) | 30 | 43 | 230 |
| 79 | | | 5 | 60 | 250 |
| 80 | | | 140 | 6 | 155 |
| 81 | | | 120 | 13 | 160 |
| 82 | Polymeth- | Lauryl | 100 | 21 | 180 |
| 83 | acrylate | acrylate | 80 | 26 | 190 |
| 84 | (6.7 parts | (0.26 parts | 60 | 30 | 195 |
| 85 | by weight) | by weight) | 30 | 40 | 230 |
| 86 | | | 5 | 55 | 245 |

Examples 73–86

Added to 100 parts by weight of a mineral oil having a viscosity of 56 $mm^2$/sec at 40° C. were 5 parts by weight of polymethacrylate as emulsifying agent (A) and 0.3 parts by weight of polybutenylsuccinic acid ester or lauryl acrylate as emulsifying agent (B), followed by heat dissolution. Then, 26.7 parts by weight of monobutyl phosphate as an extreme pressure agent was added thereto, and the mixture was stirred in a homogenizer or monomixer to prepare liquid lubricants containing the monobutylphosphate having various average particle sizes. The emulsion stability and formability of the resulting emulsion type, liquid lubricants are shown in Table 7 and FIG. 3.

Examples 87–93

Added to 100 parts by weight of α-olefin oil having a viscosity of 100 $mm^2$/sec at 40° C. were 6.7 parts by weight of polymethacrylate as emulsifying agent (A) and 0.3 parts by weight of polybutenylsuccinic acid ester as emulsifying agent (B), followed by heat dissolution. Then, 26.7 parts by weight an extreme pressure agent shown in Table 8 was added thereto, and the mixtures were stirred in a homogenizer as in Example 1, whereby emulsion-type, liquid lubricants containing the extreme pressure agent having an average particle size of 30 μm were obtained. Their emulsion stability and formability were evaluated. The results of evaluation are shown in Table 8.

TABLE 8

| Ex. No. | Extreme pressure agent | Emulsion stability (day) | Formability (°C.) |
|---|---|---|---|
| 87 | Dibutyl hydrogen phosphite | 40 | 230 |
| 88 | Diphenyl hydrogen phosphite | 44 | 235 |
| 89 | Diisodecyl hydrogen phosphite | 48 | 210 |
| 90 | Monoisodecyl phosphate | 47 | 200 |
| 91 | Methyl acid phosphate | 46 | 235 |
| 92 | Isopropyl acid phosphate | 54 | 220 |
| 93 | Butyl acid phosphate | 59 | 200 |

Example 94

It has been described above that the structure of a stirring blade has an influence on an increase in the emulsion stability in the process for preparing the present emulsion type, liquid lubricant. The influence will be explained in detail below in this Example, using an emulsion type liquid lubricant consisting of 100 parts by weight of a mineral oil having a viscosity of 150 $mm^2$/sec at 40° C., 17.6 parts by weight of monobutyl phosphate and 0.2 parts by weight of alkenylsuccinic acid ester.

Figure 4:
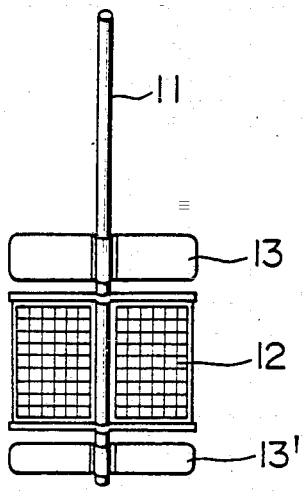
FIG. 4 is a schematic view showing one embodiment of a stirring blade of a mixer used in the preparation of the present emulsion type, liquid lubricant.

1 kg of the said liquid lubricant was emulsified by stirring with a stirring blade of stainless steel net having a mesh size of 28 mesh in the structure shown in FIG. 4 at 300 rpm for 15 minutes.

Relationsip between the emulsion stability of the liquid lubricant after the emulsification and particle size of dispersoid (monobutyl phosphate) is shown in Table 9. For comparison, the emulsion stability and the average particle size of the dispersoid when the liquid lubricant was emulsified with the ordinary propeller type stirring blade were also measured, and the results are shown in Table 9.

As is evident from Table 9, the lubricant of Example 94 has an emulsion stability equal to that of Comparative Example 5, even if the average particle size of Example 94 is 6 times as large as that of Comparative Example 5. Comparative Example 6 has a poor emulsion stability due to the broad particle size distribution, even if Comparative Example 6 has nearly equal average particle size.

TABLE 9

| | | Emulsion stability (day) | | |
|---|---|---|---|---|
| | | Comp. Ex. 5 | Comp. Ex. 6 | Example 94 |
| Average particle size | | 0.1 μm or less | 0.8 μm | 0.6 μm |
| Particle size distribution | | 0.1 μm or less | 0.5~5μ | 0.5~1μ |
| Temperature (°C.) | 25 | >30 days | <1 days | >30 days |
| | 40 | " | " | " |
| | 60 | " | " | " |
| | 80 | " | " | " |

Remarks:
Comparative Example 5: stirring at 3,000 rpm for one hour
Comparative Example 6: stirring at 300 rpm for 15 minutes Relationship between the wiremesh size (mesh) and the particle size of dispersoid when a wiremesh stirring blade was used in the present process has been found as shown in Table 10.

TABLE 10

| Mesh | μm | Particle size (μm) | (average particle size) |
|---|---|---|---|
| 100 | 149 | 0.15~0.25 | (0.2) |
| 42 | 350 | 0.20~0.35 | (0.3) |
| 28 | 590 | 0.45~0.55 | (0.5) |
| 12 | 1410 | 0.90~1.25 | (1.0) |
| 5 | 3360 | 2.85~3.30 | (3.0) |

From the viewpoint of strength and corrosion resistance, stainless steel is preferable as a material of construction for the stirring blade. Stirring blades of glass, plastics, ceramics, etc. can be also used.

As a stirring blade, it is possible to provide the conventional propeller type blades 13 and 13' on the same shaft 11 at the same time, as shown in FIG. 4, to promote liquid flowing without any bar to the desired object of the present invention.

Figure 5:
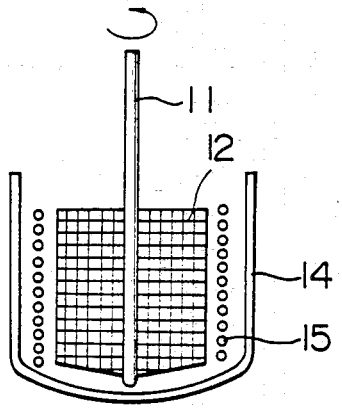
FIG. 5 is a schematic view of a mixer used in the present invention.

As a stirring apparatus, the conventional stirring tank can be used substantially as such, but higher uniformization of particle size can be obtained by providing a cylinder 15 made from a wiremesh plate having an equal mesh size near the stirring blade 12 of the present invention, as shown in FIG. 5.

What is claimed is:

1. A substantially water-free, emulsion type liquid lubricant for metal forming, which comprises:

(a) 100 parts by weight of a lubricating oil having a viscosity of 50 to 200 $mm^2$/sec at 40° C., (b) 2 to 30 parts by weight of at least one of the phosphoric acid esters represented by the general formula:

$$(RO)_n-\overset{\overset{\displaystyle O}{\|}}{P}-(X)_{3-n}$$

wherein R is selected from the group consisting of alkyl, alkylalkenyl and aryl; X is selected from the group consisting of H or OH; n is an integer of 1 to 2 when X is OH and n is 2 when X is H, and (c) at least 2 parts by weight of at least one selected from the group consisting of (A) polymethacrylate, polyisobutylene, olefin copolymer and polyalkylstyrene, and 0.04 to 5 parts by weight of (B) at least one selected from the group consisting of polybutenylsuccinic acid anhydride, polymeric succinic acid derivatives and copolymers of alkylacrylate and methacrylate monomer having a polar group, the at least one of the phosphoric acid esters being dispersed in the lubricating oil and an average particle size of the phosphoric acid ester being 0.3 to 120 μm.

2. In a process for metal forming by applying a lubricant for metal forming to the surface of a metallic workpiece or the working surface of a die or both and forming a lubricating film on the surface by virtue of heat generated during the metal forming, the improvement which comprises the lubricant being a substantially water-free, emulsion type liquid lubricant for metal forming, which comprises:

(a) a lubricating oil selected from the group consisting of a mineral oil, synthetic oil and their mixture, the lubricating oil having a viscosity of 50 to 200 $mm^2$/sec at 40°, (b) 2 to 20 parts by weight, per 100 parts by weight of the lubricating oil, of at least one of phosphoric acid esters represented by the general formula:

$$(RO)_n-\overset{\overset{\displaystyle O}{\|}}{P}-(X)_{3-n}$$

wherein R is selected from the group consisting of alkyl, alkylalkenyl and aryl; X is selected from the group consisting of OH and H; n is an integer of 1 to 2 when X is OH and n is 2 when X is H, and (c) an emulsifying agent containing (A) 2 parts by weight, per 100 parts by weight of lubricating oil, of at least one of the group consisting of polymethacrylate, polyisobutylene, olefin copolymer and polyalkylstyrene, and (B) 0.04 to 5 parts by weight, per 100 parts by weight of the lubricating oil, of at least one of the group consisting of polybutenylsuccinic acid anhydride, polymeric succinic acid derivatives and copolymers of alkylacrylate and methacrylate monomer having a polar group, the at least one of phosphoric acid esters being dispersed in said lubricating oil and having a dispersed particle size averaging 0.3 to 120 μm.

3. A process according to claim 2, wherein at least one of the metallic workpiece, the die and the liquid lubricant is heated, the liquid lubricant is applied to the metallic workpiece or the die or both, and then the metal forming is conducted.

4. A process according to claim 3, wherein the liquid lubricant is applied while heated at a temperature of at least 50° C. for at least 0.5 minutes.

5. A substantially water-free, emulsion type liquid lubricant according to claim 1, wherein the dispersed particle size of the at least one of phosphoric acid esters averages 0.5 to 80 μm.

6. A process according to claim 2, wherein the dispersed particle size of the at least one of phosphoric acid esters averages 0.5 to 80 μm.

7. A substantially water-free, emulsion type liquid lubricant according to claim 1, wherein said at least one of phosphoric acid esters is selected from the group consisting of dibutyl hydrogen phosphite, diphenyl hydrogen phosphite, diisodecyl hydrogen phosphite, monobutyl phosphate, monoisodecyl phosphate, methyl acid phosphate and butyl acid phosphate.

8. A process according to claim 2, wherein said at least one of phosphoric acid esters is selected from the group consisting of dibutyl hydrogen phosphite, diphenyl hydrogen phosphite, diisodecyl hydrogen phosphite, monobutyl phosphate, monoisodecyl phosphate, methyl acid phosphate and butyl acid phosphate.

9. A substantially water-free, emulsion type liquid lubricant according to claim 1, wherein the dispersed particles are relatively uniform in size, so as to provide a more stable lubricant as compared to a lubricant wherein the particle size of the dispersed particles is not uniform.

10. A process according to claim 2, wherein the dispersed particles are relatively uniform in size, so as to provide a more stable lubricant as compared to a lubricant wherein the particle size of the dispersed particles is not uniform.

* * * * *